US006623374B1

(12) United States Patent
Helmstetter et al.

(10) Patent No.: US 6,623,374 B1
(45) Date of Patent: Sep. 23, 2003

(54) GOLF CLUB HEAD AND SET OF GOLF CLUBS

(75) Inventors: Richard C. Helmstetter, Rancho Santa Fe, CA (US); Augustin W. Rollinson, Carlsbad, CA (US); Roger Cleveland, Los Angeles, CA (US); Karl A. Clausen, San Marcos, CA (US); Deedee Lasker, Carlsbad, CA (US); Larry G. Tang, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 10/063,359

(22) Filed: Apr. 15, 2002

(51) Int. Cl.[7] ..... A63B 53/04

(52) U.S. Cl. ..... 473/291; 473/345; 473/349; 473/350

(58) Field of Search ..... 473/324, 327, 473/345, 350, 290, 291, 349

(56) References Cited

U.S. PATENT DOCUMENTS

| | | | | |
|---|---|---|---|---|
| 3,539,184 A | * | 11/1970 | Koorland | 473/290 |
| 4,836,550 A | | 6/1989 | Kobayashi | |
| 4,854,580 A | * | 8/1989 | Kobayashi | 473/290 |
| 5,429,354 A | | 7/1995 | Long et al. | |
| 5,518,242 A | * | 5/1996 | Mahaffey et al. | 473/342 |
| 5,628,698 A | * | 5/1997 | Sumitomo | 473/341 |
| 5,683,310 A | * | 11/1997 | Chen | 473/349 |
| 5,722,900 A | * | 3/1998 | Sung | 473/291 |
| 5,746,666 A | | 5/1998 | Lovett | |
| 5,863,259 A | * | 1/1999 | Sacco | 473/290 |
| 5,916,038 A | * | 6/1999 | Uchiyama et al. | 473/290 |
| 5,984,803 A | * | 11/1999 | Chappell | 473/291 |
| 6,139,446 A | | 10/2000 | Wanchena | |
| 6,315,678 B1 | * | 11/2001 | Teramoto | 473/291 |
| 6,368,232 B1 | * | 4/2002 | Hamada et al. | 473/329 |

FOREIGN PATENT DOCUMENTS

| | | |
|---|---|---|
| JP | 5-317465 | * 12/1993 |
| JP | 2000-157651 | * 6/2000 |

OTHER PUBLICATIONS

The Golf Club: 400 years of the Good, Ellis, Jeffrey B., 2003.

* cited by examiner

*Primary Examiner*—Stephen Blau
(74) *Attorney, Agent, or Firm*—Michael A. Catania; Elaine H. Lo

(57) ABSTRACT

A golf club head and a set of golf clubs that are more forgiving are disclosed herein. The golf club head has an open cavity with an extended bottom wall in order to lower the center of gravity of the club head and to increase the moment of inertia of the club head. The set of golf clubs preferably consists of a driver, a plurality of fairway woods and a plurality of irons, with each of the club heads having a lower center of gravity and increased moment of inertia. Each club head preferably has a moment of inertia of at least 2600 grams centimeter squared.

5 Claims, 7 Drawing Sheets

| | INCHES | | | GRAMS-CM ^ 2 @ CG | | |
|---|---|---|---|---|---|---|
| | CG-X | CG-Y | CG-Z | Ixx | Iyy | Izz |
| 18* DRIVER | 0.720 | 0.630 | 0.840 | 2574 | 1419 | 3052 |
| 25* FAIRWAY WOOD | 0.768 | 0.723 | 0.671 | 2413 | 1284 | 2955 |
| 30* FAIRWAY WOOD | 0.839 | 0.758 | 0.660 | 2471 | 1348 | 3084 |
| 35* IRON | 0.634 | 1.069 | 0.737 | 2606 | 858 | 2639 |
| 45* IRON | 0.649 | 1.144 | 0.779 | 2935 | 910 | 2974 |
| 55* IRON | 0.716 | 1.203 | 0.646 | 2819 | 1006 | 3000 |

GOLF CLUB HEAD AND SET OF GOLF CLUBS

CROSS REFERENCE TO RELATED APPLICATIONS

Not Applicable

FEDERAL RESEARCH STATEMENT

Not Applicable

BACKGROUND OF INVENTION

1. Field of the Invention

The present invention relates to golf clubs. More specifically, the present invention relates to golf clubs having an open cavity to increase forgiveness.

2. Description of the Related Art

It is desirable to have a golf club that is lightweight, while offering a wider sole and a lower center of gravity. Such a golf club would allow novice and average golfers to play shots with more ease and reliability and use clubs more suited for shot.

Various clubs have been designed in an attempt to provide these attributes. One such example is U.S. Pat. No. 5,429,354, issued on Jul. 4, 1995 (the '354 patent). The club in the '354 patent is a crownless golf club having an elongated flange extending from a point on the sole to the striking face. Because of the lightweight face, a composition insert is required to provide low rear weight distribution on the club head to improve the striking quality by reducing the vibration of the metal face and face section.

Another example is U.S. Pat. No. 5,518,242, issued on May 21, 1996, which is a continuation-in-part of the '354 patent. The crownless club head of the '242 patent utilizes a composition insert secured to the rim of the striking face section composed of titanium or compression molded titanium alloy plates.

Another example is U.S. Pat. No. 5,746,666, issued on May 5, 1998. This patent provides a club head with a face surface that narrows downwardly toward the sole in conjunction with a sole surface that extends upwardly toward the top wall thereby reducing contact with the turf and limiting drag resistance.

Another example is U.S. Pat. No. 6,139,446, issued on Oct. 31, 2000. This patent provides a mass region running linearly from a lip section extending between the striking surface and the top side of the mass region to a point of farthest reach on the top sole section.

Another example is U.S. Pat. No. 4,836,550, issued on Jun. 6, 1989. This patent is for an iron-type club head having a back wall connected at one end to the sole extending perpendicularly and connected at an opposite striking face at the point of impact.

SUMMARY OF INVENTION

One aspect of the present invention is a golf club head having a body composed of a metal material. The body has a front wall, a bottom wall extending rearward from a bottom end of the front wall and a top wall extending rearward from a top end of the front wall. The bottom wall extends a greater distance rearward than the top wall. The front wall, the bottom wall and the top wall define an open cavity. The club head has a loft angle of at least 15 degrees and the club head has a moment of inertia through the Izz axis of the center of gravity of at least 2500 grams centimeter squared.

In one embodiment, the club head is a driver club head having a moment of inertia through the Izz axis of the center of gravity of at least 2900 grams centimeter squared. In another embodiment, the club head is a fairway wood club head having a loft angle of at least 19 degrees and having a moment of inertia through the Izz axis of the center of gravity of at least 2900 grams centimeter squared. In yet another embodiment, the club head is an iron club head having a loft angle of at least 29 degrees and having a moment of inertia through the Izz axis of the center of gravity of at least 2600 grams centimeter squared.

Another aspect of the present invention is a set of golf clubs including a driver, a plurality of fairway woods and a plurality of irons. The driver has a loft angle ranging from 15 degrees to 18 degrees and the driver has a moment of inertia through the Izz axis of the center of gravity of at least 2900 grams centimeter squared. Each of the plurality of fairway woods has a loft angle ranging from 19 degrees to 30 degrees and each of the fairway woods has a moment of inertia through the Izz axis of the center of gravity of at least 2900 grams centimeter squared. Each of the plurality of irons has a loft angle ranging from 29 degrees to 60 degrees and each of the irons has a moment of inertia through the Izz axis of the center of gravity of at least 2600 grams centimeter squared.

DETAILED DESCRIPTION

Figure 1:
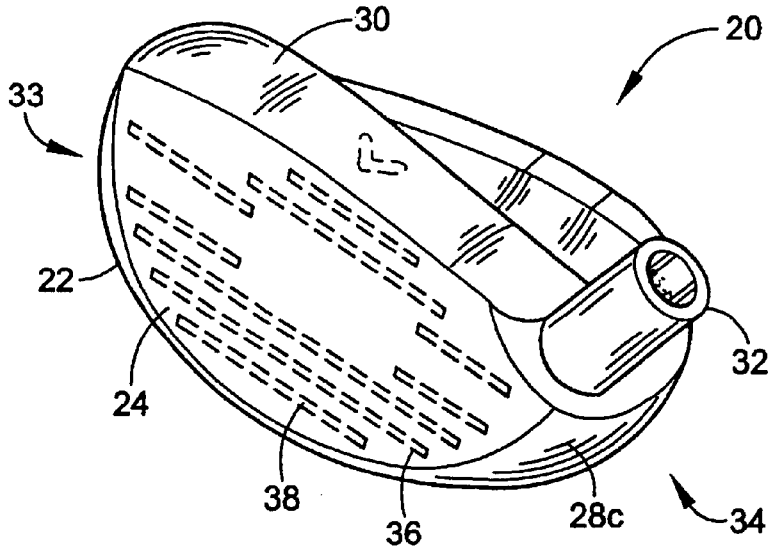
FIG. 1 is a top perspective view of a driver club head of the present invention.

The present invention is directed at golf clubs and at a set of golf clubs for the golfer that plays infrequently or has difficulty utilizing current equipment. The golf club of the present invention has increased forgiveness to make the game of golf more enjoyable for the infrequent golfer.

FIGS. 1–8 illustrate a driver club head of the present invention, FIGS. 9–16 illustrate a fairway wood club head of the present invention, and FIGS. 17–24 illustrate an iron club head of the present invention. Each of the club heads of the present invention has a body with an open cavity in order to preferably lower the center of gravity.

A golf club head is generally designated 20. The golf club head 20 has a body 22 preferably composed of a stainless steel, a titanium alloy, other steel alloys, and the like. The body 22 is preferably cast using a technique such as a lost-wax method; however, it may be alternatively composed of forged or formed pieces.

The body 22 is generally composed of a front wall 24, a bottom wall 26, a ribbon wall 28, a top wall 30 and a hosel 32. The ribbon wall is preferably partitioned into a rear ribbon wall 28*a*, a toe ribbon wall 28*b* and a heel ribbon wall 28*c*. The hosel 32 is located at a heel end 34 of the club head 20 which is opposite of a toe end 33 of the club head 20.

The front wall 24 has a striking surface 36, which is intended to impact a golf ball during a golf swing. The striking surface 36 of the front wall 24 preferably has a plurality of scorelines 38 thereon for increasing friction with a golf ball during impact. The front wall 24 preferably has a thickness that ranges from 0.050 inch to 0.200 inch, more preferably from 0.080 inch to 0.150 inch, and most preferably 0.095 inch to 0.120 inch. The thickness of the front wall 24 is preferably uniform. Alternatively, the front wall 24 has variable thickness such as disclosed in U.S. Pat. Nos. 5,830,084, 6,368,234, and 6,398,666, Ser. No. 09/606,809, which are hereby incorporated by reference for the driver and fairway wood club heads 20 of FIGS. 1–16, and such as disclosed in U.S. Pat. No. 5,971,868 which is hereby incorporated by reference for the iron club head 20 of FIGS. 17–24.

The bottom wall 26 has a sole surface 40 that contacts the ground during a golfers swing. The sole surface 40 may have graphics and other indicia thereon. The bottom wall has a thickness that ranges from 0.025 inch to 0.150 inch and more preferably from 0.040 inch to 0.100 inch. The bottom wall 26 is preferably uniform in thickness. Alternatively the bottom wall 26 has a tapered thickness that decreases in thickness from the front wall 24 toward the rear ribbon wall 28*a*.

The body 22 has an open cavity 50 that is defined by the front wall 24, the bottom wall 26, the ribbon wall 28 and the top wall 30. In conventional drivers and fairway woods, a crown would cover such an open cavity, adding weight to the club head and raising the center of gravity of the club head. However, the absence of a crown, and thus the open cavity 50 allows for the lowering of the center of gravity of the club heads 20 of the present invention. The top wall 30 acts as a partial crown, covering a relatively small portion of the open cavity 50, preferably less than 33% of the open cavity 50. The top wall 30 adds support to the front wall 24 during impact with a golf ball and also visually assists a golfer during a swing. In order to assist a golfer in striking the center of the striking surface 36 during impact, indicia 51 indicates the center of the striking surface 36. The top wall 30 preferably has a thickness that ranges from 0.025 inch to 0.150 inch and more preferably from 0.040 inch to 0.100 inch. The top wall 30 is preferably uniform in thickness. Alternatively the top wall 30 has a tapered thickness that decreases in thickness from the front wall 24 rearward.

An interior sole surface 52 and an interior ribbon surface 54 are exposed through the open cavity 50. A perimeter is formed around the open cavity 50 through a top wall edge 56 and a ribbon wall edge 58.

Figure 7:
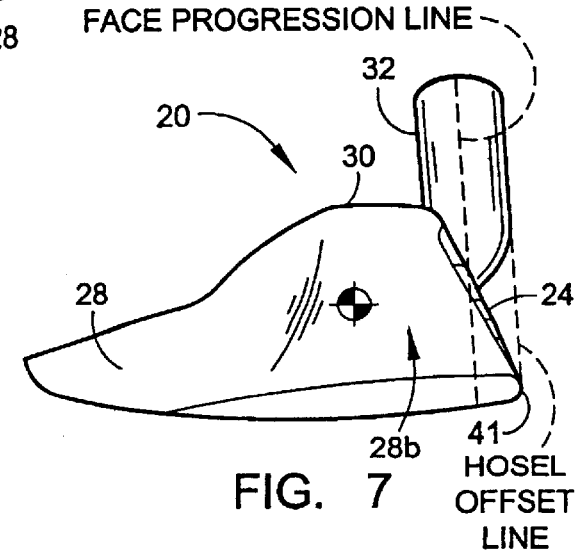
FIG. 7 is a toe side view of the driver club head of FIG. 1.
Figure 9:
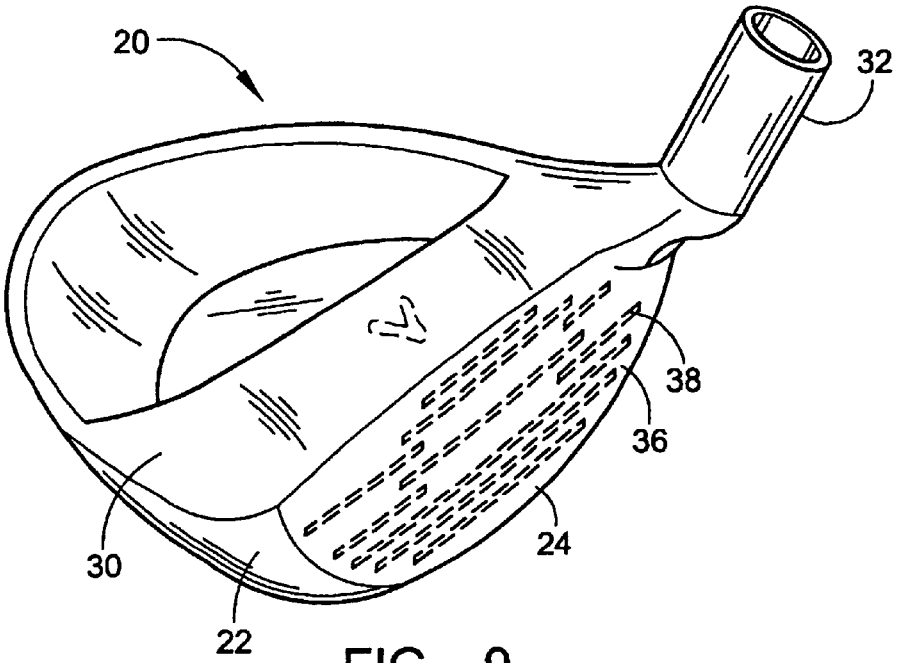
FIG. 9 is a top perspective view of a fairway wood club head of the present invention.

The club head 20 preferably has an offset hosel 32. A shaft (not shown) is placed within a bore 44 that is defined by a hosel wall 42. As defined on page 514 of *Golf Club Design, Fitting, Alternation & Repair, The Principles & Procedures,* by Ralph Maltby, Ralph Maltby Enterprises, Inc. ($4^{th}$ Edition 1995), the Hosel Offset is the distance from the farthest front portion of the hosel to the farthest front portion of the face on its centerline, and the Face Progression is defined as the distance from the centerline of the shaft or hosel bore to the farthest front portion of the face on its centerline. As shown in FIG. 7 for a driver, in FIG. 15 for a fairway wood and FIG. 23 for an iron, the hosel offset, the distance from the farthest front portion of the hosel 32 to the farthest front portion 41 of the front wall 24 is preferably zero. The face progression from the centerline of the hosel bore 44 is preferably rearward of the front wall 24.

In a preferred embodiment, the driver club head 20 of FIGS. 1–8 has a loft angle of 15 degrees to 18 degrees, most preferably 18 degrees. The lie angle is preferably 56 degrees to 58 degrees. The mass of the driver club head 20 is preferably 180 grams to 250 grams, and most preferably 217 grams.

Figure 2:
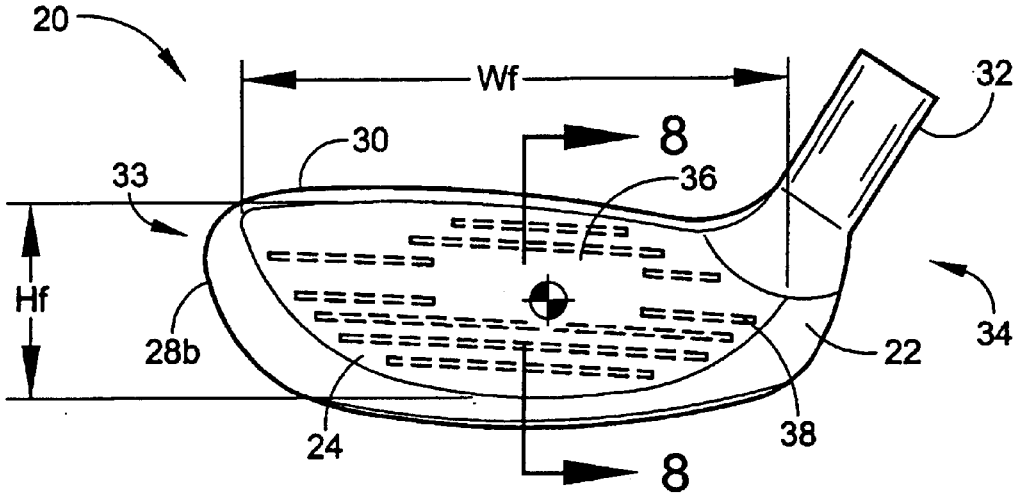
FIG. 2 is a front view of the driver club head of FIG. 1.
Figure 3:
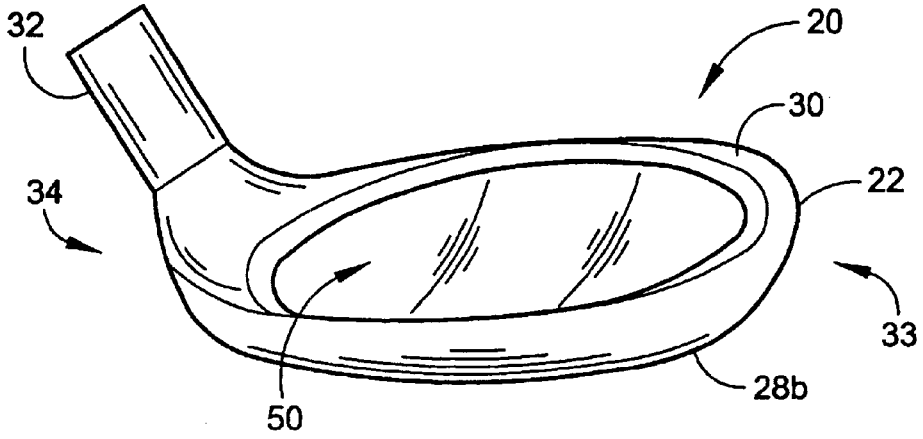
FIG. 3 is a rear view of the driver club head of FIG. 1.
Figure 4:
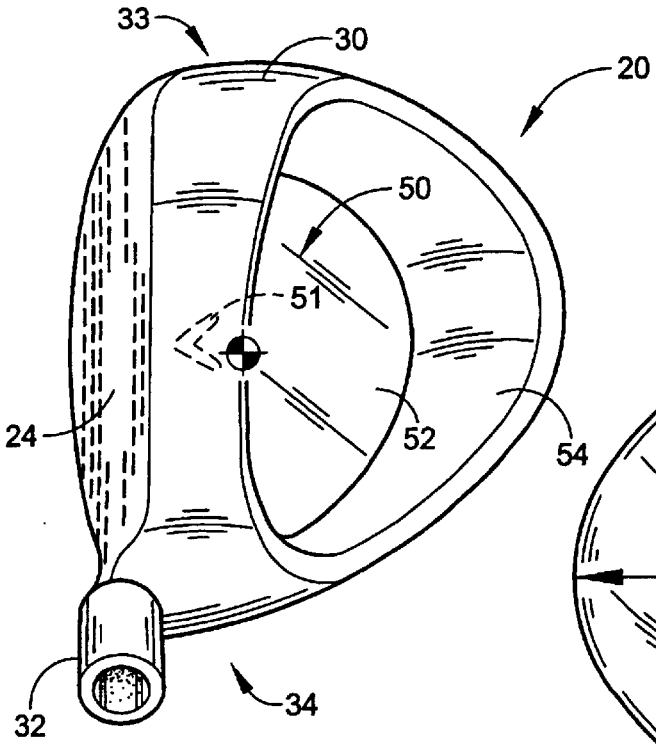
FIG. 4 is a top plan view of the driver club head of FIG. 1.
Figure 5:
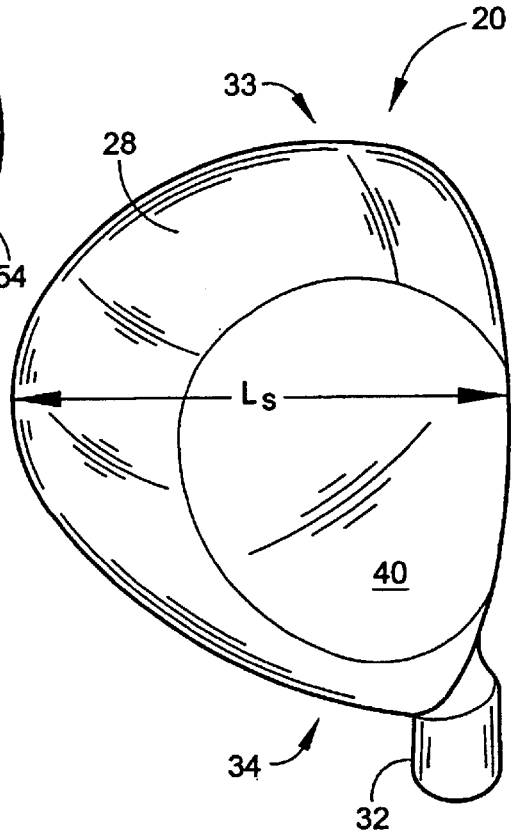
FIG. 5 is a bottom view of the driver club head of FIG. 1.
Figure 6:
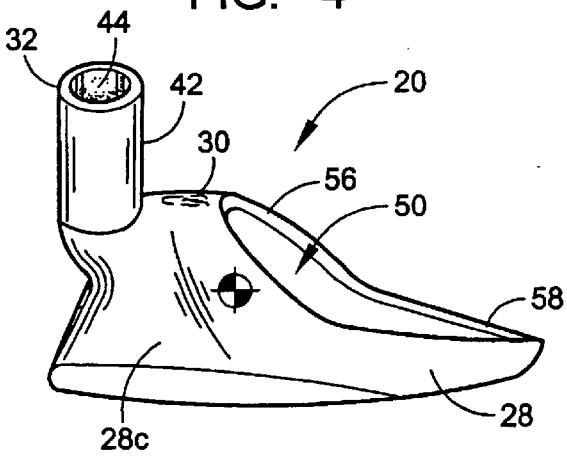
FIG. 6 is a heel side view of the driver club head of FIG. 1.
Figure 8:
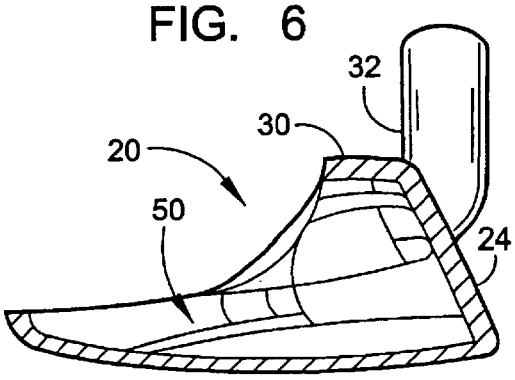
FIG. 8 is a cross sectional view of the driver club head taken along lines 8—8 of FIG. 2.

As shown in FIG. 5, the driver club head 20 has a length, Ls, that preferably ranges from 2.75 inches to 3.50 inches and more preferably from 3.00 inches to 3.25 inches. As shown in FIG. 2, the driver club head has a face width, Wf, that ranges from 2.75 inches to 4.50 inches, more preferably 3.00 inches to 3.75 inches, and most preferably from 3.20 inches to 3.5 inches, and a face height, Hf, that preferably ranges from 1.50 inches to 2.00 inches, and more preferably form 1.60 inches to 1.80 inches.

The driver club head 20 preferably has a bulge radius ranging from 16 inches to 24 inches, more preferably from 18 inches to 22 inches, and most preferably 20 inches. The driver club head 20 preferably has a roll radius ranging from 7 inches to 14 inches, more preferably from 8 inches to 12 inches, and most preferably 10 inches. For the driver embodiment, the face progression from the centerline of the hosel bore 44 to the front edge 41 preferably ranges from 0.250 inch to 0.400 inch, and is most preferably 0.280 inch.

The top wall 30 of the driver embodiment preferably has a thickness that ranges from 0.090 inch to 0.170 inch and more preferably from 0.100 inch to 0.150 inch. The top wall 30 is preferably uniform in thickness. Alternatively the top wall 30 has a tapered thickness that decreases in thickness from the center outward toward the heel end 34 and the toe end 33 of the golf club head 20. The bottom wall 26 of the driver embodiment preferably has a thickness that ranges from 0.040 inch to 0.100 inch and more preferably from 0.045 inch to 0.055 inch. The bottom wall 26 is preferably uniform in thickness. Alternatively the bottom wall 26 has a tapered thickness that decreases in thickness from the center outward toward the heel end 34 and the toe end 33 of the golf club head 20. The ribbon wall 28 preferably has a thickness that ranges from 0.045 inch to 0.055 inch near the bottom wall 26, thickening upward with a thickness of the edge 58 of preferably 0.140 inch. The front wall 24 of the driver embodiment preferably has a thickness that ranges from 0.060 inch to 0.150 inch and more preferably from 0.090 inch to 0.100 inch. The front wall 24 of the iron embodiment is preferably uniform in thickness, however, as mentioned above, it may have variable thickness.

In a preferred embodiment, the fairway wood club head 20 of FIGS. 9–16 has a loft angle of 19 degrees to 30 degrees, most preferably 25 degrees. The lie angle is preferably 56 degrees to 58.5 degrees, and most preferably 57 degrees. The mass of the fairway wood club head 20 preferably ranges from 200 grams to 300 grams and most preferably ranges from 230 grams to 245 grams.

Figure 10:
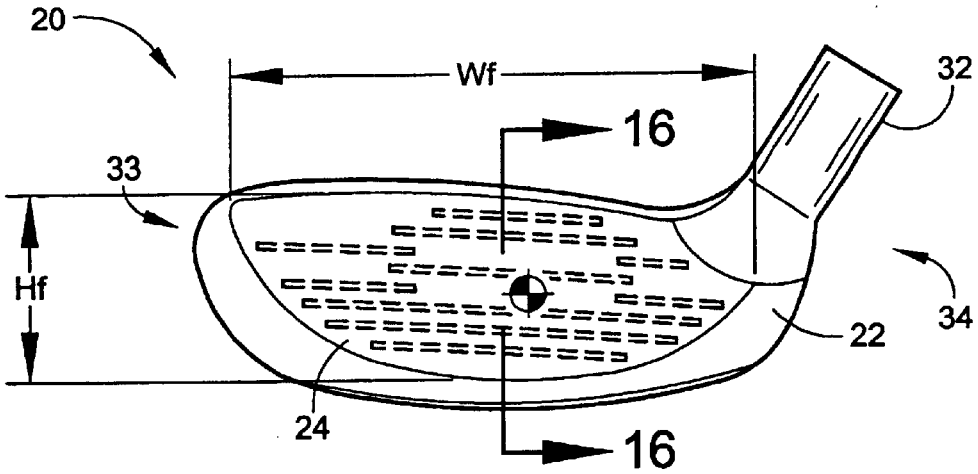
FIG. 10 is a front view of the fairway wood club head of FIG. 9.
Figure 11:
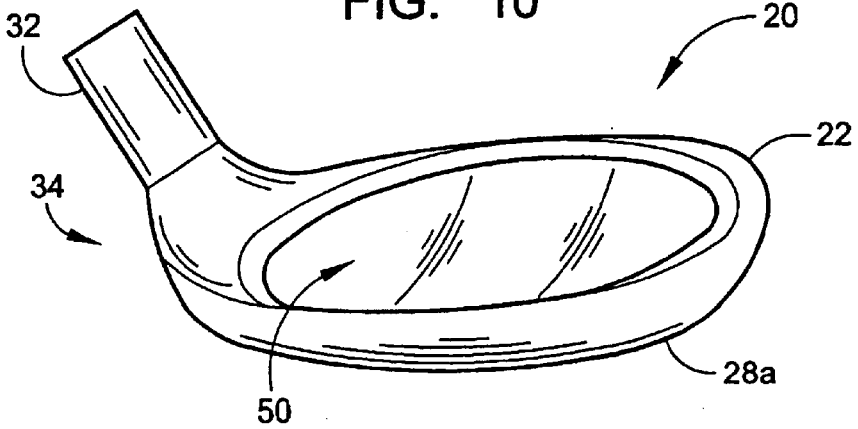
FIG. 11 is a rear view of the fairway wood club head of FIG. 9.
Figure 12:
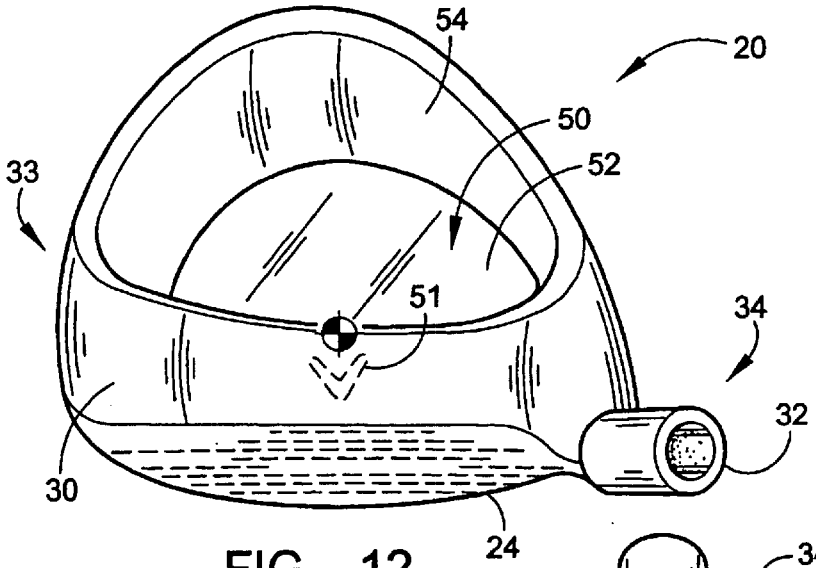
FIG. 12 is a top plan view of the fairway wood club head of FIG. 9.
Figure 14:
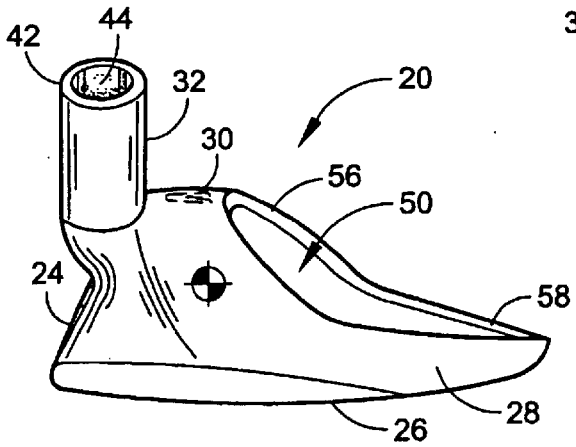
FIG. 14 is a heel side view of the fairway wood club head of FIG. 9.
Figure 13:
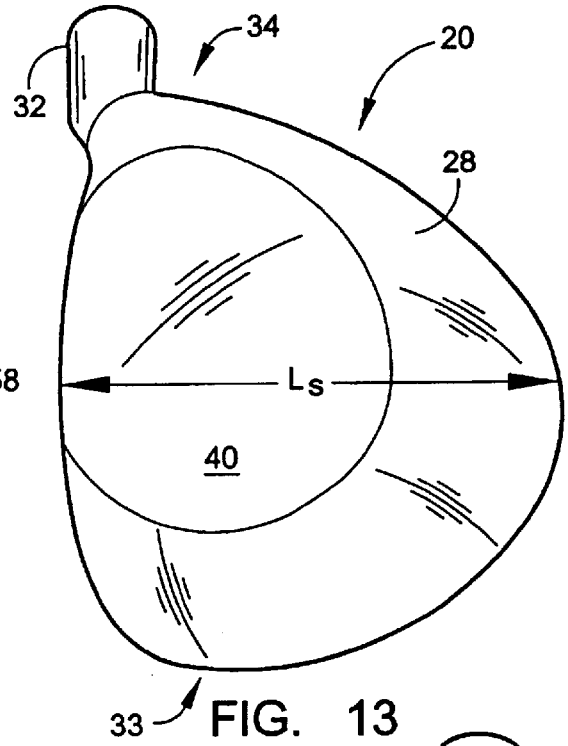
FIG. 13 is a bottom view of the fairway wood club head of FIG. 9.
Figure 15:
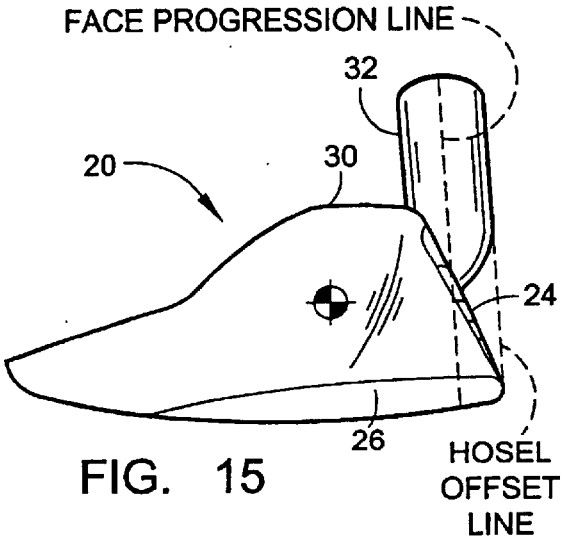
FIG. 15 is a toe side view of the fairway wood club head of FIG. 9.
Figure 16:
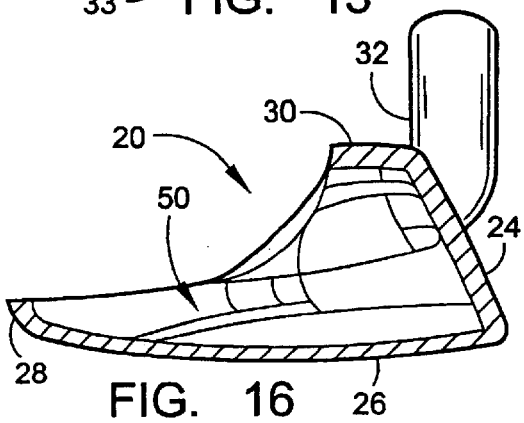
FIG. 16 is a cross sectional view of the fairway wood club head taken along lines 16—16 of FIG. 10.
Figure 17:
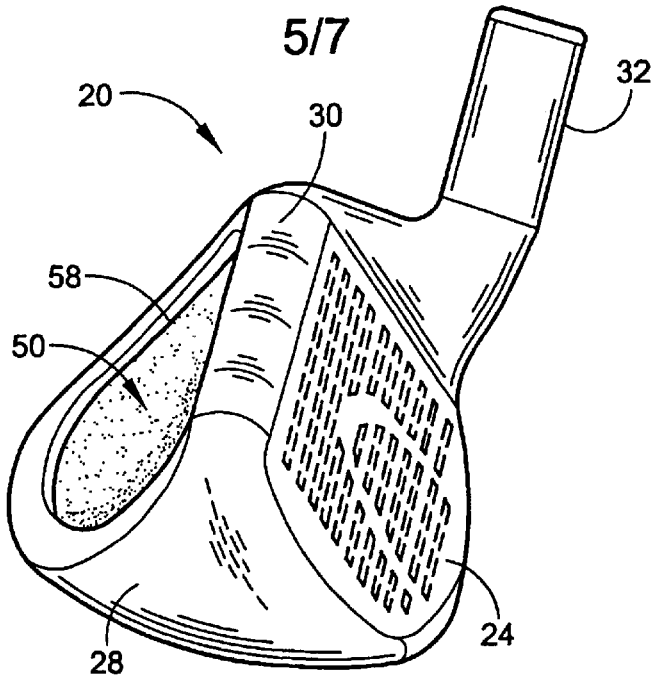
FIG. 17 is a top perspective view of an iron club head of the present invention.

As shown in FIG. 13, the fairway wood club head 20 has a length, Ls, that preferably ranges from 2.75 inches to 3.50 inches and more preferably from 3.0 inches to 3.25 inches. As shown in FIG. 10, the fairway wood club head has a face width, Wf, that ranges from 2.50 inches to 4.25 inches, more preferably 2.75 inches 3.50 inches, and most preferably from 3.00 inches to 3.30 inches and a face height, Hf, that preferably ranges from 1.25 inches to 2.00 inches, and more preferably from 1.40 inches to 1.75 inches.

The fairway wood club head 20 preferably has a bulge radius ranging from 16 inches to 24 inches, more preferably from 18 inches to 22 inches, and most 20 inches. The fairway wood club head 20 preferably has a roll radius ranging from 7 inches to 14 inches, more preferably from 8 inches to 13 inches, and most preferably 12 inches. For the fairway wood embodiment, the face progression from the centerline of the hosel bore 44 to the front edge 41 preferably ranges from 0.250 inch to 0.400 inch, and is most preferably 0.270 inch.

The top wall 30 of the fairway wood embodiment preferably has a thickness that ranges from 0.090 inch to 0.170 inch and more preferably from 0.100 inch to 0.155 inch. The top wall 30 is preferably uniform in thickness. Alternatively the top wall 30 has a tapered thickness that decreases in thickness from the center outward toward the heel end 34 and the toe end 33 of the golf club head 20. The bottom wall 26 of the fairway wood embodiment preferably has a thickness that ranges from 0.040 inch to 0.100 inch and more preferably from 0.060 inch to 0.080 inch. The bottom wall 26 is preferably uniform in thickness. Alternatively the bottom wall 26 has a tapered thickness that decreases in thickness from the center outward toward the heel end 34 and the toe end 33 of the golf club head 20. The ribbon wall 28 preferably has a thickness that ranges from 0.070 inch to 0.080 inch near the bottom wall 26, thickening upward with a thickness of the edge 58 toward the top wall of preferably 0.160 inch. The front wall 24 of the fairway wood embodiment preferably has a thickness that ranges from 0.060 inch to 0.150 inch and more preferably from 0.100 inch to 0.110 inch. The front wall 24 of the iron embodiment is preferably uniform in thickness, however, as mentioned above, it may have variable thickness.

In a preferred embodiment, the iron club head 20 of FIGS. 17–24 has a loft angle of 29 degrees to 60 degrees, most preferably 35 degrees for a long iron, 45 degrees for a mid-iron and 55 degrees for a short iron. The lie angle is preferably 60 degrees to 65 degrees, and most preferably 63 degrees. The mass of the iron club head 20, is preferably 220 grams to 320 grams, most preferably 247 grams for a long iron, 266 grams for a mid-iron and 300 grams for a short iron.

Figure 18:
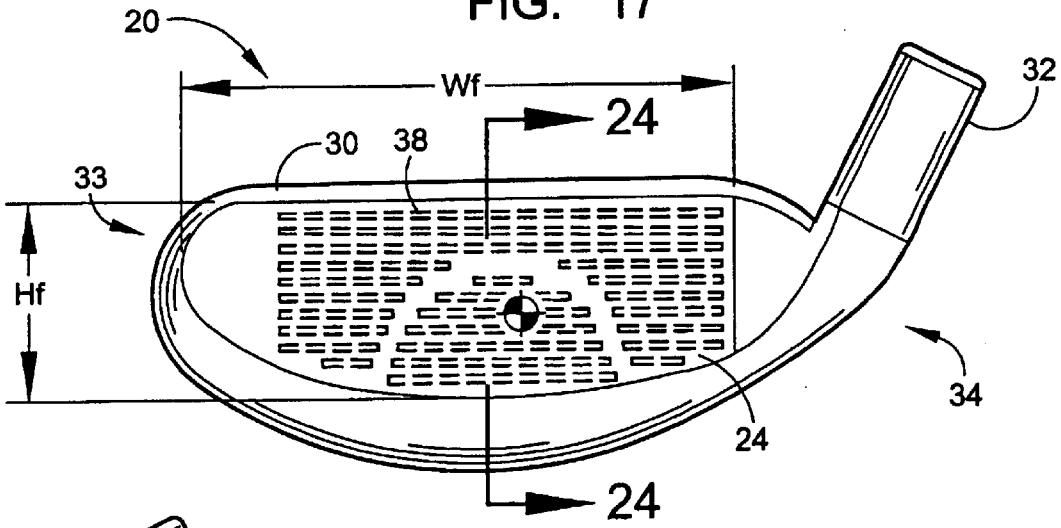
FIG. 18 is a front view of the iron club head of FIG. 1.
Figure 19:
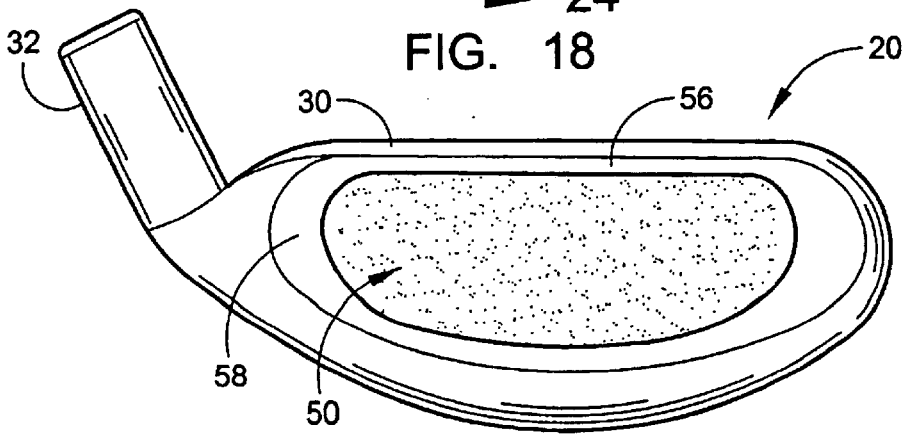
FIG. 19 is a rear view of the iron club head of FIG. 1.
Figure 20:
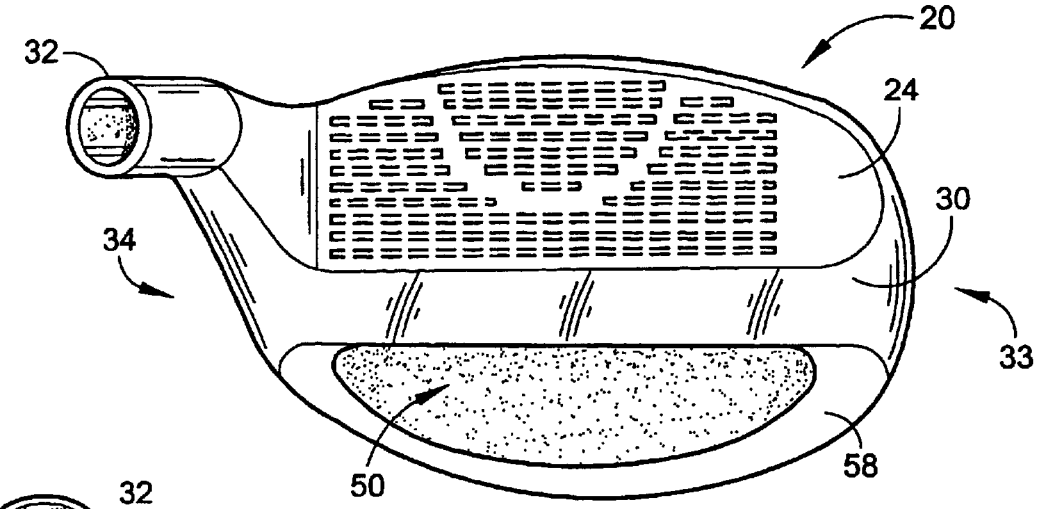
FIG. 20 is a top plan view of the iron club head of FIG. 1.
Figure 22:
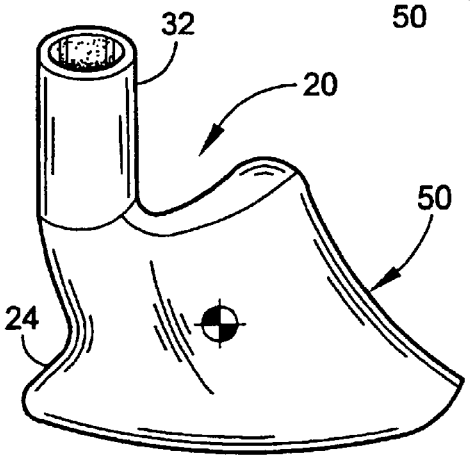
FIG. 22 is a heel side view of the iron club head of FIG. 1.
Figure 21:
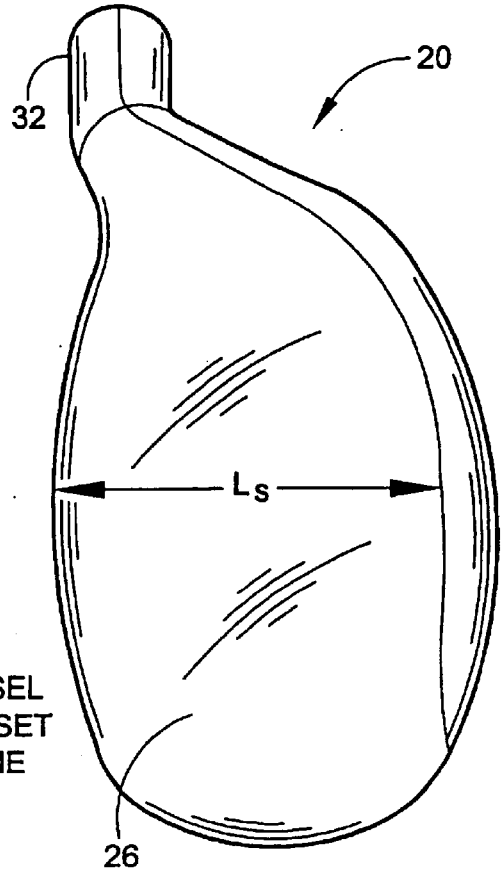
FIG. 21 is a bottom view of the iron club head of FIG. 1.
Figure 23:
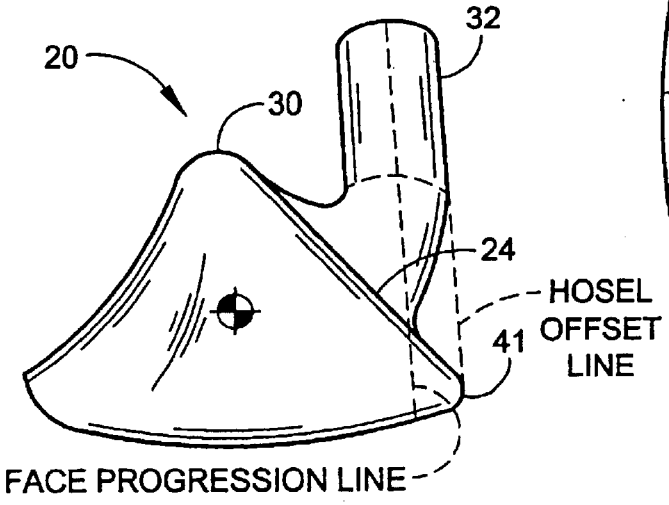
FIG. 23 is a toe side view of the iron club head of FIG. 1.

As shown in FIG. 21, the iron club head 20 has a length, Ls, that preferably ranges from 2.0 inches to 3.0 inches, and more preferably ranges from 2.25 inches to 2.50 inches. As shown in FIG. 18, the iron club head has a face width, Wf, that ranges from 3.00 inches to 3.50 inches, and more preferably ranges from 3.10 inches to 3.30 inches, and a face height, Hf, that preferably ranges from 1.30 inches to 1.70 inches, and more preferably ranges from 1.40 inches to 1.65 inches. The face progression from the centerline of the hosel bore 44 to the front edge 41 preferably ranges from 0.275 inch to 0.400 inch, and is most preferably 0.370 inch for a long iron, 0.330 inch for a mid-iron and 0.292 inch for a short iron.

The top wall 30 of the iron embodiment preferably has a thickness that ranges from 0.090 inch to 0.170 inch and more preferably from 0.100 inch to 0.150 inch. The top wall 30 is preferably uniform in thickness. Alternatively the top wall 30 has a tapered thickness that decreases in thickness from the front wall 24 rearward. The bottom wall 26 of the iron embodiment preferably has a thickness that ranges from 0.050 inch to 0.330 inch and more preferably from 0.170 inch to 0.280 inch. The bottom wall 26 is preferably uniform in thickness. Alternatively the bottom wall 26 has a tapered thickness that decreases in thickness from the center outward toward the heel end 34 and the toe end 33 of the golf club head 20. The front wall 24 of the iron embodiment preferably has a thickness that ranges from 0.100 inch to 0.150 inch and more preferably from 0.105 inch to 0.115 inch. The front wall 24 of the iron embodiment is preferably uniform in thickness, however, as mentioned above, it may have variable thickness.

Figures 24, 25:
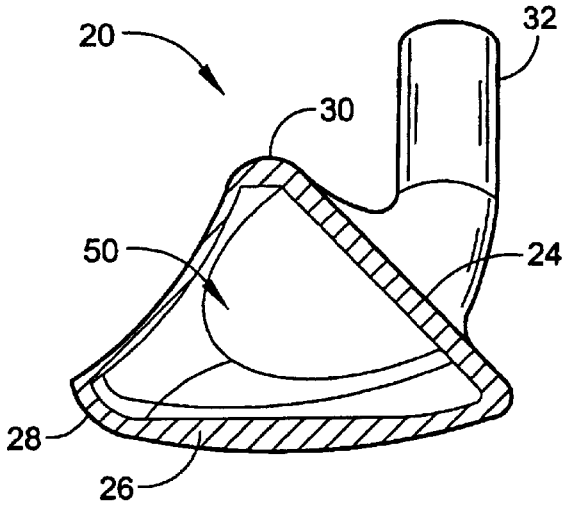
FIG. 24 is a cross sectional view of the iron club head taken along lines 24—24 of FIG. 18.
FIG. 25 is a Table of the center of gravity location and the moment of inertia for a preferred set of golf clubs.

FIG. 25 is a table of the position of the center of gravity of a club head 20 and the moment of inertia, Ixx, about the X axis of the golf club head 20, the moment of inertia, Iyy, about the Y axis of the golf club head 20, and the moment of inertia, Izz, about the Z axis of the golf club head 20. The center of gravity is shown as the CG. The CG is given in relation to the shaft center line and the ground plane. A method for calculating the center of gravity and measuring the moment of inertia is set forth in co-pending U.S. patent application No. 09/796,951, filed on Feb. 27, 2001, entitled High Moment Of Inertia Composite Golf Club, and hereby incorporated by reference in its entirety. The axes of inertia through the center of gravity of the golf club head 20 are designated X, Y and Z. The X axis extends from the front wall 24 through the center of gravity, CG, and to the rear of the golf club head 20. The Y axis extends from the toe end 33 of the golf club head 20 through the center of gravity, CG, and to the heel end 34 of the golf club head 20. The Z axis extends from the bottom wall 26 through the center of gravity, CG, and through the top wall 30.

We claim as our invention:

1. An iron-type golf club head comprising:

a body composed of a metal material, the body having a front wall with a face width ranging from 3.00 inches to 3.50 inches and a face height ranging from 1.30 inches to 1.70 inches, a bottom wall extending from 2.0 inches to 3.0 inches rearward from a bottom end of the front wall and the bottom wall having a thickness ranging from 0.050 inch to 0.330 inch, a top wall extending rearward from a top end of the front wall, and a ribbon wall extending upward from a bottom wall, the bottom wall extending a greater distance rearward than the top wall, from a hosel the front wall, the ribbon wall, the bottom wall and the top wall defining an open cavity when viewed from the top of a head with a head at a designated loft angle wherein the iron-type golf club head has a face progression from the centerline of a hosel bore to a front edge of the front wall ranging from 0.275 inch to 0.400 inch, has a loft angle of at least 29 degrees and has a moment of inertia through the Izz axis of the center of gravity of at least 2600 gas centimeter squared.

2. A set of golf clubs comprising:

a driver having a body having a front wall with a face width ranging from 2.75 inches to 4.50 inches and a face height ranging from 1.50 inches to 2.00 inches, a bottom wail extending from 3.00 inches to 3.25 inches rearward from a bottom end of the front wall and the bottom wall having a thickness ranging from 0.040 inch to 0.100 inch, a top wall extending rearward from a top end of the front wall, and a ribbon wall extending upward from the bottom wall, the bottom wall extending a greater distance rearward than the top wall, the front wall, the ribbon wall, the bottom wall and the top wall defining an open cavity, the ribbon wall lower than the front wall, the top wall extending rearward from the front wall to cover less than 33% of the open cavity, and wherein the driver has a face progression from the centerline of a hosel bore to a front edge of the front wall range from 0.250 inch to 0.400 inch, the driver has a loft angle ranging from 15 degrees to 18 degrees and the driver has a moment of inertia through the Izz axis of the center of gravity of at least 2900 grams centimeter squared;

a plurality of fairway woods, each of the fairway wood having a body having a front wall with a face width ranging from 2.50 inches to 4.25 inches and a face height ranging from 1.25 inches to 2.00 inches, a bottom wall extending from 2.75 inches to 3.50 inches rearward from a bottom end of the front wall and the bottom wall having a thickness ranging from 0.040 inch to 0.100 inch, a top wall extending rearward from a top end of the front wall; and a ribbon wall extending upward from the bottom wall, the bottom wall extending a greater distance rearward than the top wall, the front wall, the ribbon wall, the bottom wall and the top wall defining an open cavity, the ribbon wall lower than the front wall, the top wall extending rearward from the front wall to cover less than 33% of the open cavity, and wherein each of the fairway woods has a face progression from the centerline of a hosel bore to a front edge of the front wall ranging from 0.250 inch to 0.400 inch, each fairway wood has a loft angle ranging from 19 degrees to 30 degrees and each of the fairway woods has a moment of inertia through the Izz axis of the center of gravity of at least 2900 grams centimeter squared; and a plurality of irons, each of the irons having a body having a front wall with a face width ranging from 3.00 inches to 3.50 inches and a face height ranging from 1.30 inches to 1.70 inches, a bottom wall extending from 2.0 inches to 3.0 inches rearward from a bottom end of the front wall and the bottom wall having a thickness ranging from 0.005 inch to 0.330 inch, a top wall extending rearward from a top end of the front wall, and a ribbon wall extending upward from the bottom wall, the bottom wall extending a greater distance rearward than the top wall, from a hosel the front wall, the ribbon wall, the bottom wall and the top wall defining an open cavity, when viewed from the top of a head with a head at a designated loft angle and wherein each iron has a face progression from the centerline of a hosel bore to a front edge of the front wall ranging from 0.275 inch to 0.400 inch, each of the irons has a loft angle of ranging from 29 degrees to 60 degrees and each of the irons has a moment of inertia through the Izz axis of the center of gravity of at least 2600 grams centimeter squared.

3. The set of golf clubs according to claim 2 wherein each of the driver, the plurality of fairway woods and the plurality of irons is composed of stainless steel.

4. The set of golf clubs according to claim 2 wherein each of the driver, the plurality of fairway woods and the plurality of irons is composed of a titanium alloy.

5. The set of golf clubs according to claim 2 wherein the plurality of irons consists of a long iron having a loft angle of 35 degrees, a mid-iron having a loft angle of 45 degrees and a short iron having a loft angle of 55 degrees.

* * * * *